United States Patent [19]

Hay

[11] 4,052,107

[45] Oct. 4, 1977

[54] HYDRAULIC HAMMERS HYDRAULICALLY DRIVEN IMPACTOR

[75] Inventor: Andrew George Hay, Hamilton, Scotland

[73] Assignee: Secretary of State for Industry in Her Britannic Majesty's Government of the U.K. of Great Britain and Nothern Ireland, London, England

[21] Appl. No.: 674,410

[22] Filed: Apr. 7, 1976

[30] Foreign Application Priority Data

Apr. 8, 1975 United Kingdom ..... 14438/75

[51] Int. Cl.[2] ..... E21D 9/10

[52] U.S. Cl. ..... 299/62; 91/291; 91/308; 91/313; 173/134; 173/DIG. 4

[58] Field of Search ..... 299/62; 175/96; 91/308, 91/313, 292, 291; 173/52, 134, 127, DIG. 4

[56] References Cited

U.S. PATENT DOCUMENTS

| | | | |
|---|---|---|---|
| 1,717,597 | 6/1929 | App | 299/62 X |
| 2,665,667 | 1/1954 | Tolkien | 91/291 X |
| 3,609,969 | 10/1971 | Gerber | 173/127 X |
| 3,701,386 | 10/1972 | Feucht | 173/134 X |
| Re. 21,798 | 5/1941 | Johnston | 91/308 X |

*Primary Examiner*—Ernest R. Purser

*Attorney, Agent, or Firm*—Cameron, Kerkam, Sutton, Stowell & Stowell

[57] ABSTRACT

The disclosure concerns a hydraulically driven impactor in which the operating cycle of a reciprocating piston is determined by the retraction velocity and displacement of the piston itself. Energy is conserved and heat dissipation minimised by the utilization of hydraulic spring accumulators to decelerate the piston. The drive to the piston is switched into a forward direction at such a point in each displacement cycle that the rebound energy of the piston is always re-absorbed into the drive fluid. The impactor operates at optimum acceleration and frequency at all times, whether or not impact occurs, and this feature combined with high energy conservation makes the impactor particularly suitable for use in a full-face tunnelling machine where high power density is required and individual impactors are often constrained to operate without impacting the rock face for considerable periods.

4 Claims, 4 Drawing Figures

FIG. I.

HYDRAULIC HAMMERS HYDRAULICALLY DRIVEN IMPACTOR

This invention relates to hydraulic drives for reciprocating equipment, and particularly, though not exclusively, to drives for rock cutting impactors by which a cutting tool is repeatedly driven against a rock face to be excavated.

When such impactors are used in confined spaces, as in tunelling, it is important to minimise energy loss due to absorption of kinetic energy after each stroke. Otherwise in the use of heavy duty machines severe problems arise from the consequent overheating of the hydraulic fluid or the expense of providing adequate means of cooling. The proposed method of achieving this is to utilise gas or hydraulic spring accumulators and a system of velocity/displacement-sensitive switching to ensure that the drive for the impactor is switched into a forward direction at such a point in each displacement cycle that the rebound energy of the impactor is always re-absorbed into the drive system without non-useful dissipation of the energy as heat.

This technique is illustrated with reference to the accompanying FIG. 1, which is a "phase-plane" diagram in which is plotted the velocity of a rock-cutting impactor as a function of its displacement.

Starting from rest at position A, the velocity of the impactor will follow the parabolic curve to B under a constant forward force. If the direction of force is at that point reversed, the impactor will, in the absence of impact, slow down, come to rest at its furthest advance position C and then accelerate rearwardly to reach point D. The form of the parabolic curve BCD will depend on the rearward force which is not necessarily the same as the forward force — in this case the forward force is slightly greater. If the direction of force is again reversed at D, which is at the same position of the impactor as B, the impactor will undergo an acceleration forwards, coming to rest at A and moving forward along AB as before.

With the impactor coming to rest at its fully retracted position A, a maximum of energy can be stored in accumulators so that a high forward speed can be attained without requiring input power, giving consequent heating, other than that to overcome frictional losses.

It, however, the cutter makes contact with the rock face during its forward movement and after reverse switching occurs, curves such as EF, GH, etc will be traced, followed by a rearward acceleration along curves which, on the diagram, are rearward displacements of the parabola CD. It can be clearly seen that if forward switching occurs on the line BD, the impactor will come to rest at a point, such as J for the curve EF, from which an insufficient forward speed can be developed.

Ideally, the position of forward switching should be varied according to the forward rest position (eg F, H or C) of the impactor so that switching occurs at positions such as K and L, ie where the rearward acceleration curve after impact intersects the curve DA. In this way, the impactor will always come to rest at or close to A, regardless of whether or where there has been an impact.

This invention accordingly consists of a hydraulically powered drive for a reciprocating tool in which the tool is driven alternately in a forward and rearward direction, the driving force switching from a rearward to a forward direction by the operation of a valve actuated by hydraulic pressure built up by the rearward motion of the tool the degree of which pressure depends on the position and speed of the tool.

In a preferred embodiment the valve is actuated by a spool-type pilot valve and the reciprocating tool comprises a piston moveable within a cylinder, the rearward face of the piston being provided with a blind hole into which an extension stem of the pilot valve spool can enter, the increase of pressure of fluid in the blind hole produced by entry therein of the extension on retraction of the piston causing a rearward movement of the extension and consequent actuation of the pilot valve at a piston position dependent on the speed of the piston. The extension is preferably tapered in a forward direction, and by suitable profiling of the taper the switching position can be arranged to substantially correspond with the points such as K and L on FIG. 1.

By way of example, embodiments of the invention will now be described with reference to the accompanying drawings of which:-

Figure 2:
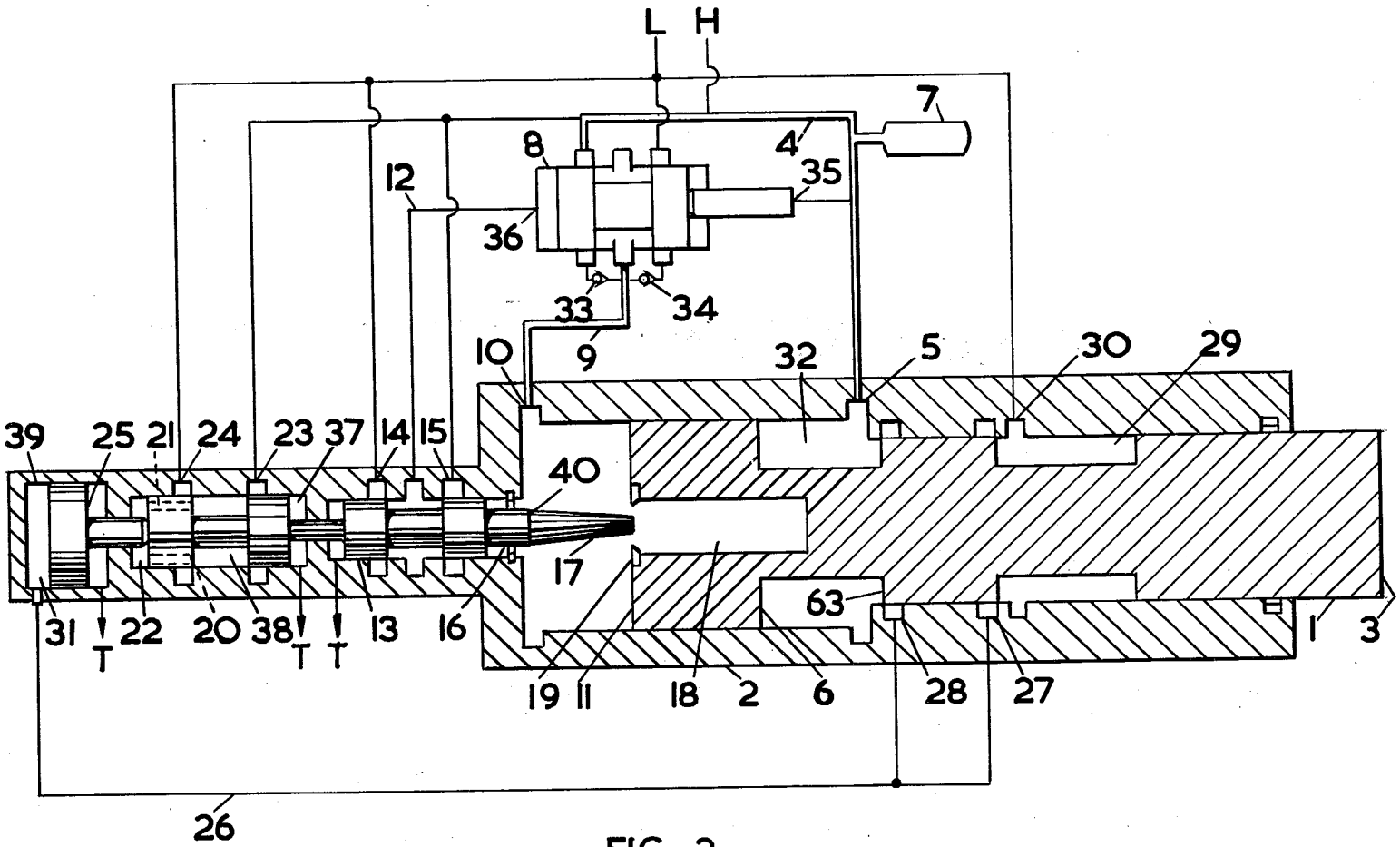
FIG. 2 is a schematic diagram of a hydraulic impactor constructed in accordance with the invention.

The impactor illustrated in FIG. 2 comprises a main piston 1 slidable within a main cylinder 2, an impact face 3 of the main piston being arranged to contact and drive forward a suitable rock cutting tool (not shown) which may be loosely mounted in a frame supporting the impactor, the frame retaining the tool against the rock face, or alternatively, may be directly fastened to the impact face 3.

The main piston is driven by hydraulic pressure from high pressure supply line H, a duct 4 communicating directly between the line H and an inlet port 5 opening into the cylinder 2 adjacent a groove 32 in the main piston 1. Groove 32 has a forward face 63 and a rearward face 6, the forward face 63 being of smaller area than the face 6, so that during operation the net effect of high pressure hydraulic fluid admitted to the groove 32 is to continuously urge the piston 1 rearwardly. The duct 4 also communicates with a hydraulic accumulator 7 and an inlet of a switch valve 8 which is of the conventional spool type. The outlet of the switch valve 8 communicates via a duct 9 with a port 10 in the cylinder so that high pressure hydraulic fluid can be admitted to act forwardly against a main face 11 of the piston 1. The main face 11 of the piston has a greater area than the difference between faces 6 and 63 so that when the valve 8 is switched to produce a high pressure in the duct 9 the piston 1 is urged forwardly to impact, or drive, the cutting tool. The ducts 9 and 4 are of large cross-section to reduce viscous losses when rapid flow takes place on movement of the piston.

A second inlet of the valve 8 is connected to a low pressure hydraulic line L, which may conveniently be constituted by a return line to a hydraulic reservoir, and when the valve 8 is switched to connect the outlet with this low pressure inlet, fluid communicating with the face 11 of the piston via duct 9 is reduced to low pressure and the piston is retracted by the high pressure fluid maintained in the groove 32. As the valve 8 passes through its mid-switching position, the duct 9 is momentarily closed off from both switch valve inlets and in order to permit continuing fluid flow through the duct 9, resulting from movement of the piston 1 throughout this brief period, two non-return valves 33 and 34 are provided to connect the duct 9 with the high and low pressure inlets respectively.

One driving port 35 of the valve 8 is connected to the high pressure line H. Another driving port 36 is connected by duct 12 to the outlet of a pilot valve 13, which is also a spool valve and located coaxially with respect of the cylinder 2. The inlet ports 14 and 15 of the pilot valve are respectively connected to the low and high pressure hydraulic lines, inlet port 14 being located further than inlet 15 from the cylinder 2.

The spool of the pilot valve 13 is provided with a cylindrical extension stem 16 which extends towards the cylinder and has a further tapered portion 17 which can extend into a blind hole 18 formed axially in the piston 1. The blind hole is provided with an annular collar 19 of erosion-resistant material tapering inwardly to produce a sharp edged restricted opening to the blind hole, so that on retraction of the piston 1, the pressure of fluid within the blind hole due to the entry therein of the tapered portion 17 urges the tapered portion rearwardly, at an instant dependent on the speed of retraction of the piston, and therefore switches the pilot valve 13 at an instant which is dependent on the velocity and position of the piston 1. The sharp-edged opening of the blind hole 18 minimises any variation in this position due to variations in the viscosity of the fluid. On such switching, the duct 12 is switched to low pressure whereby the high pressure at the driving port 35 urges the valve 8 to the position in which duct 9 becomes filled with fluid at high pressure so causing acceleration of the piston 1 in a forward direction.

Coaxially mounted on the stem of the pilot valve 13, at its end remote from the piston 1 is a latch valve 37. The rearward land 20 of the latch valve is penetrated by orifices 21 whereby a chamber 22 at the end of the latch valve remote from the piston 1 is in fluid communication with a groove 38 which is filled with fluid at high or low pressure from ducts 23 and 24 respectively, depending on the axial position of the latch valve spool and hence of the spool and stem of the pilot valve 13. Within the chamber 22 and extending into a cylinder 39 is a piston 25 which may or may not urge the latch valve 37 forward according to the differential pressure across its faces; the areas of the faces of the piston 25 are so arranged that when the portion 31 of the cylinder 39 remote from the latch valve is at high pressure the piston 25 is urged forward even when the chamber 22 is at high pressure. The portion 31 of the cylinder 39 remote from the latch valve is connected via a duct 26 with two ports 27 and 28 in the cylinder 1. When the piston 1 is in the rearward part of its range of travel, port 27 communicates with a groove 29 in the piston and hence with a port 30 connected to the low pressure hydraulic line so that the portion 31 of the cylinder 39 is at low pressure. When the piston 1 is in the forward part of its range of travel, the port 27 is blocked by the piston 1 and the port 28 communicates with the groove 32 and thus with inlet port 5, thus maintaining the portion 31 of the cylinder 39 at high pressure.

The groove 38 between the lands of the latch valve 37 contains hydraulic fluid at high or low pressure from respectively inlet ports 23 and 24, depending on the axial position of the spool. The remainder of the chambers in the pilot valve/latch valve assembly are provided with venting ducts (not shown) connecting with a drain tank T.

Figure 1:
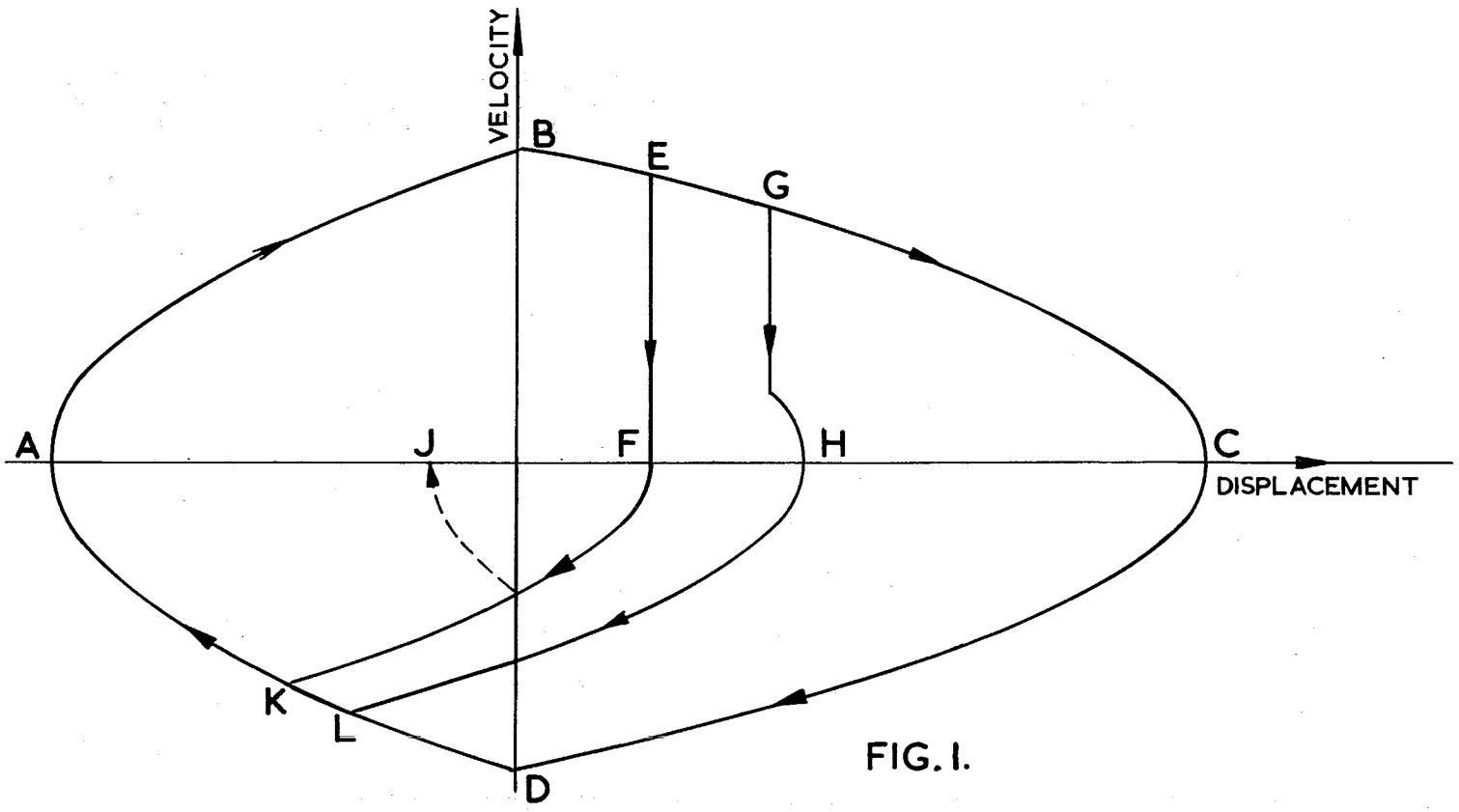

In operation, when the piston 1 is in its fully retracted position (at A in FIG. 1) the duct 9 and the groove 32 are at high pressure and duct 26 is at low pressure, and hence the piston 1 is being accelerated forward by the differential action of the forces acting on its faces 11, 6 and 63. When it reaches its mid-point of travel, however, the port 28 comes into communication with the groove 32 which is maintained at high pressure, so that the duct 26 and hence the portion 31 are switched to high pressure and the piston 25 is urged forward, pushing the spools of the latch valve and of the pilot valve forward and the tapered extension 17 into the blind hole 18, and also opening duct 12 to high pressure. The switch valve 8 therefore switches, so connecting duct 9 to low pressure whereby the piston 1 begins to decelerate under the force of the high pressure constantly acting against the face 6 and 63. This occurs at a point of travel corresponding to B in FIG. 1.

In the event of no impact between the cutting tool and the rock, the piston will decelerate under the net action of the force on its faces 11, 6 and 63 until a forward rest position is reached (C in FIG. 1), and then accelerate rearwards. At rearward positions of the piston 1, the duct 26 is switched to low pressure on being in communication with inlet port 30, so that the piston 25 retracts under the action of high pressure in the groove 38. Reverse speed of the main piston 1 increases until the point at which the pressure in the fluid in the blind hole 18 builds up, owing to the constriction between the collar 19 and the tapered portion 17 of the stem restricting escape of the fluid, sufficiently to overcome the force exerted by the high pressure in the groove 38 urging the latch valve and pilot valve forward. The valve spools thus retract; the latch valve spool to a position in which the groove 38 becomes filled with fluid at a low pressure and the pilot valve spool to the position in which duct 12 is at low pressure, whereupon the switch valve 8 switches to the position in which duct 9 and hence the face 11 of the piston are subjected to high pressure. The piston thus begins to slow down. By profiling the tapered portion appropriately, the constriction at the collar 19 can be made such that the switch position occurs at the same position of the piston (corresponding to D in FIG. 1) at which the switch valve is actuated on piston advance. The tapered portion is so located axially as to be completely outside the blind hole when the piston is in the forward part of its range of travel, so that the valve cannot be switched by the above means until the piston is rearward of its mid-point of travel, whatever its speed. After switching, the piston slows down to rest at its retracted position before moving forward again to start the next cycle.

If, however, an impact takes place in the forward part of the movement of the piston, a rapid deceleration to rest will ensue after which the piston will commence to move rearwardly as before under the action of high pressure on faces 6 and 63. However, as this rearward acceleration has started from a less forward piston position (e.g. at F or H on FIG. 1), the speed at the previous switch position (on line BD) will be insufficient to switch the pilot and latch valves. The piston will thus continue to increase its speed of retraction until the force on the tapered portion of the stem is sufficient to switch these valves. By suitably profiling the tapered portion, the switch instant, as a function of the piston position and speed, can be made to approximate to the ideal situation discussed above. A step 40 is provided between the cylindrical and tapered portions to enable the collar 19 to physically move the stem and the valve spools if the speed of retraction of the main piston is too slow for the fluid pressure to have any effect. After switching, the piston comes to rest at substantially the same rearward position irrespective of any impact, before moving forward again, so that the maximum forward velocity attained before reverse switching occurs does not fall below the optimum for the system.

Figure 3:
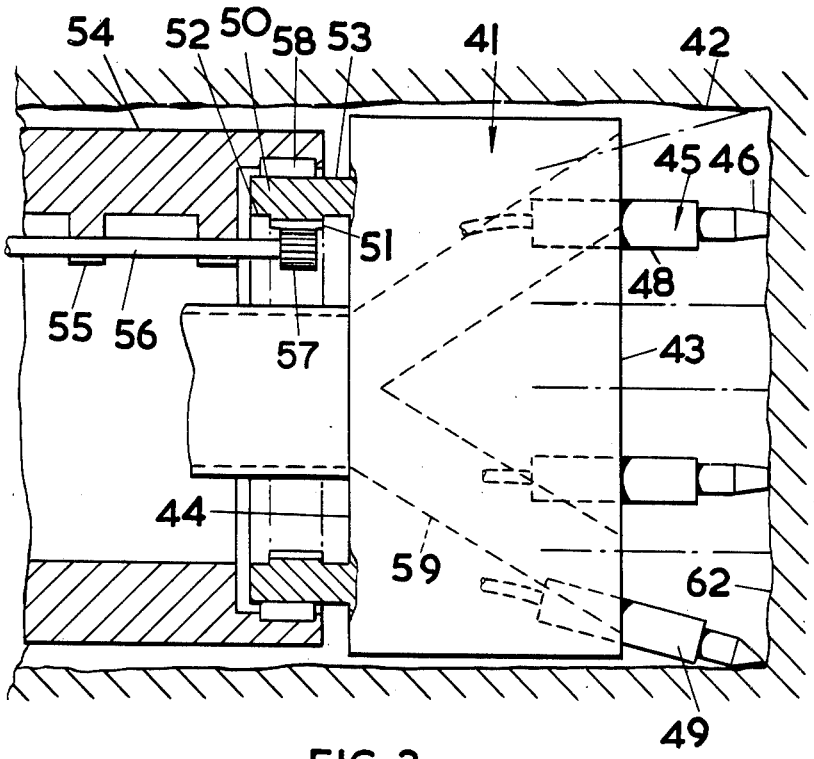
FIG. 3 is a diagrammatic sectional representation of a multiple array of hydraulic impactors constructed with the invention, arranged to provide a full-face tunnelling head.
Figure 4:
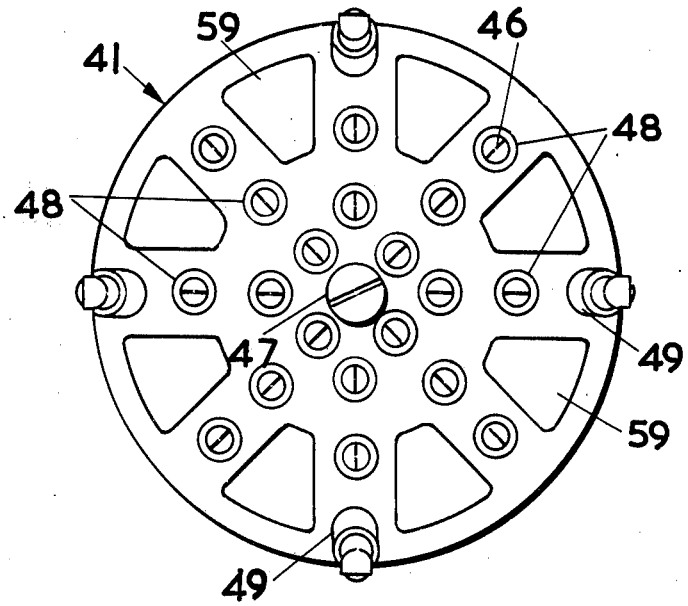
FIG. 4 is a diagrammatic view of the front cutting face of the tunnelling head illustrated in FIG. 3.

An example of a full-face rock tunnelling head having a multiple array of hydraulic impactors according to the invention, is illustrated in FIGS. 3 and 4. The tunnelling head comprises a cylindrical cutting head 41 having a forward face 43 is which are positioned a plurality of impact cutting tool units 48 each comprising an impactor 45 fitted with a chisel shaped tool bit 46. The tool bits 46, one corresponding to each impact cutting tool 48, are shown in FIG. 4, but for convenience only three of the tools are illustrated in FIG. 3.

The impact cutting tools 48 are disposed on the forward end of the cutting head 41, in sets of four at each of several radial distances from the centre of the forward face, the tools of each set being disposed equiangularly at 90° intervals around the face. Since each of the sets of four tools 48 is located at a different radial distance from the centre of the forward face 43 it will be seen that by oscillating the cutting head about the cylinder axis through approximately 90°, substantially all of the abutting area of a rock face 62 will be swept by the tools 48.

Each impact cutting tool located at a common radial distance from the centre of the face 43 is offset by 45° from the adjacent tools at a radially greater and radially smaller distance from the centre of the forward face 43 so that adjacent impactors 45 are well separated.

A single impact cutting tool having a large diameter chisel-shaped tool bit 47 (FIG. 4) is located at the centre of the forward face 43.

The four impact cutting tools at the radially greatest distance from the centre of the forward face 43, one of which 49 is illustrated in FIG. 3, may be inclined to the axis of the cutting head to ensure that the periphery of the rock face 62 is cut with sufficient clearance to permit forward advancement of the cutting head into the resulting tunnel 42. The remainder of the tools 48 are mounted with their axes parallel to the axis of the cylindrical cutting head 41.

Passageways 59 are provided through the cylindrical cutting head 41, which permit spoil egression from the forward face 43 to the rear face 44.

The rear face 44 of the cutting head 41 has an annular flange 50 extending rearwardly therefrom. The inner face 52 of the flange has a gear ring 51, and a roller bearing 58 located on the outer face 53 of the flange engages a track in a main frame 54 to rotatably mount the cutting head on the hollow cylindrical main frame 54. The main frame 54 has a plurality of journal bearings 55 which support a drive shaft 56 having a gear ring 57 at one end engaging the gearing 51 on the flange 50.

In operation the drive shaft 56 is arranged to impart a continuous rotary oscillatory motion to the cutting head 41 via the gear rings 57 and 51 so that the cutting head 41 oscillates through approximately 90°, and the full face of the tunnel will be swept by the tools 48.

Hydraulic supply and return lines (not shown) are connected to each of the impactors 45 to operate the tools to produce a high energy continual hammering of the chisel-shaped tool bits into the tunnel face.

The full face tunnelling head, by using individual impact cutting tool units each having a small cutting area, will generally produce smaller sized spoil than with conventional machines, which spoil is easier to remove from the tunnel face by a conveyor system.

The use of a plurality of individual impact cutting tools allows an accurate tunnel profile to be cut, avoiding overcutting and the necessity of back filling. Also an accurate tunnel profile will ensure that any tunnel lining, if required, will be an accurate fit.

Further, by using an impact type of cutting tool the jacking forces required to help stabilise such tunnelling machines, even when cutting very hard rock, will generally be less than those required when using other hard rock tunnelling machines.

I claim :

1. A hydraulically operable impactor comprising: a main piston reciprocable within a cylinder, said piston having opposing transverse faces and said cylinder having fluid transfer means for admitting pressurised hydraulic fluid to the said faces to advance and retract said main piston within said cylinder; a switch valve for controlling admission of said pressurised hydraulic fluid to at least one of said faces; and control means for actuating said switch valve, hydraulically arranged to initiate advancement of said main piston via said switch valve in response to a fluid pressure increase generated by said main piston during retraction thereof at an axial displacement of said main piston which is dependent upon the velocity thereof.

2. A full-face tunnel cutting head comprising an array of hydraulically operable impactors, each as claimed in claim 1, each provided with a cutting tool attached to the forward end of said main piston, and each mounted in a forward face of a cutting head; and drive means for imparting angular oscillation to the cutting head about an axis lying in the direction of cutting, said impactors being disposed about said axis such that substantially the whole area of an abutting tunnel face is swept by the cutting tools during angular oscillation.

3. A hydraulically operable impactor comprising: a main piston reciprocable within a cylinder, said piston having opposing transverse faces, and said cylinder having means for admitting pressurised hydraulic fluid to the said faces; a switch valve for controlling admission of hydraulic fluid to at least one of said faces; and control means for operating said switch valve comprising a pilot valve in the form of a spool valve, the spool of said pilot valve having a stem which is aligned axially with a blind recess formed in a transverse face of the main piston, said stem being engageable in said recess during retraction of the main piston, and the profiles of said stem and said recess defining an annular clearance between the stem and the sides of the recess which reduces as the main piston retracts.

4. A hydraulically operable impactor as claimed in claim 3, further comprising a latch valve having a spool which is operatively connected with the spool of said pilot valve; and hydraulic pressure operated means controlled by the position of the main piston for biasing the spool of said latch valve to maintain the spool of the pilot valve axially advanced towards the main piston at all times when said stem is disengaged from said recess.

* * * * *